US007614830B1

(12) United States Patent
Ritke

(10) Patent No.: US 7,614,830 B1
(45) Date of Patent: Nov. 10, 2009

(54) PRE-CAST RETAINING WALL SYSTEM AND METHOD

(75) Inventor: Greg Ritke, Sumner, WA (US)

(73) Assignee: Tri-State Construction, Inc., Bellevue, WA (US)

( * ) Notice: Subject to any disclaimer, the term of this patent is extended or adjusted under 35 U.S.C. 154(b) by 0 days.

(21) Appl. No.: 10/819,719

(22) Filed: Apr. 7, 2004

Related U.S. Application Data

(60) Provisional application No. 60/461,587, filed on Apr. 7, 2003.

(51) Int. Cl.
*E01F 13/02* (2006.01)

(52) U.S. Cl. ..... 405/286; 404/6

(58) Field of Classification Search ..... 405/286, 405/284, 262; 52/609; 404/6
See application file for complete search history.

(56) References Cited

U.S. PATENT DOCUMENTS

| | | | | | |
|---|---|---|---|---|---|
| 1,778,574 | A * | 10/1930 | Thornley | 405/286 |
| 3,959,938 | A * | 6/1976 | Zachariassen | 52/293.1 |
| 4,000,622 | A * | 1/1977 | Chiaves | 405/286 |
| 4,776,725 | A * | 10/1988 | Brade | 405/31 |
| 5,125,765 | A * | 6/1992 | Verble | 405/31 |
| 6,523,312 | B2 * | 2/2003 | Budge | 52/284 |

* cited by examiner

*Primary Examiner*—Tara Mayo-Pinnock
(74) *Attorney, Agent, or Firm*—Christensen O'Connor Johnson Kindness PLLC

(57) ABSTRACT

Embodiments of retaining wall systems suitable for use as a traffic barrier for roadways include a prefabricated concrete retaining wall section and a pour-in-place footing. Another system includes a pre-cast retaining wall section and a pre-cast footing. In use, a plurality of retaining wall sections may be placed side-by-side in close proximity to one another to allow for a continuous retaining wall to be constructed.

12 Claims, 11 Drawing Sheets

PRE-CAST RETAINING WALL SYSTEM AND METHOD

CROSS-REFERENCE(S) TO RELATED APPLICATION(S)

This application claims the benefit of U.S. Provisional Application No. 60/461,587, filed Apr. 7, 2003, the disclosure of which is hereby incorporated by reference.

FIELD OF THE INVENTION

The present invention relates generally to pre-cast retaining wall systems and methods. These retaining wall systems are generally used to stabilize earth that has been removed or displaced during road construction. Roadways that have cut through a hill or roadways that are comprised of different levels typically require such reinforcement.

BACKGROUND OF THE INVENTION

Concrete retaining walls used in highway construction are typically poured in place. This process usually consists of excavating the soil and earth away from the wall area. Excavating the soil to a point below the bottom level of the wall serves as a location for a footing. A form for the footing is prepared, reinforced with steel and concrete, and then the footing is poured on site. After the footing cures, the remaining walls are then formed on the footing, reinforced with steel and concrete poured on site. If required, a traffic barrier may be placed on top of the wall using similar construction techniques as outlined above. Once the completed wall has cured, the soil is then replaced.

Creating retaining walls by building and pouring the walls on site is costly, time consuming and labor intensive. Typically extra excavation or other earth supporting means are necessary and are unacceptably costly. Also important are the time and space constraints imposed on such construction projects, particularly in urban environments, where time is of the essence to minimize traffic disruptions and where frequently there is insufficient room to construct walls by forming and pouring the walls in place.

Therefore, a need exists for a retaining wall system and method that can provide the desired support and flexibility in design necessary to make it adaptable to all construction situations as well as being more cost, time and labor efficient. The pre-cast wall systems described herein meet these needs and others.

SUMMARY OF THE INVENTION

In accordance with aspects of the present invention, a pre-cast retaining wall is provided. The wall includes a wall body having a front surface, a back surface, a top surface, a bottom surface, and first and second side surfaces; and a first support leg extending from the bottom surface of the wall body and a second support leg extending from the bottom surface of the wall body a spaced distance from the first support leg such that a gap is formed therebetween.

In accordance with another aspect of the present invention, a method of erecting a retaining wall system at a site is provided. The method includes obtaining a pre-cast retaining wall section formed at a location different from the site. The pre-cast wall section has a base and defines a height, a width, and a length. The method also includes preparing a trench having a bottom surface. The bottom surface of the trench is sized to define an area larger than the bottom surface of the retaining wall section. The method further includes placing the pre-cast retaining wall in the trench in an upright orientation; and making a footing around a base of the retaining wall.

In accordance with yet another aspect of the present invention, a method of erecting a retaining wall system at a site is provided. The method includes forming a footing on a ground surface of the site. The footing has at least one reinforcement member protruding upwardly therefrom. The method also includes obtaining a pre-cast retaining wall section formed at a location different from the site. The pre-cast wall section has at least one bore cooperatively sized and arranged to loosely receive the reinforcement member when the retaining wall section is placed on the footing. The method further includes placing the retaining wall onto the footing.

BRIEF DESCRIPTION OF THE DRAWINGS

The foregoing aspects and many of the attendant advantages of this invention will become more readily appreciated by reference to the following detailed description, when taken in conjunction with the accompanying drawings, wherein.

DETAILED DESCRIPTION OF THE PREFERRED EMBODIMENTS

Figure 1:
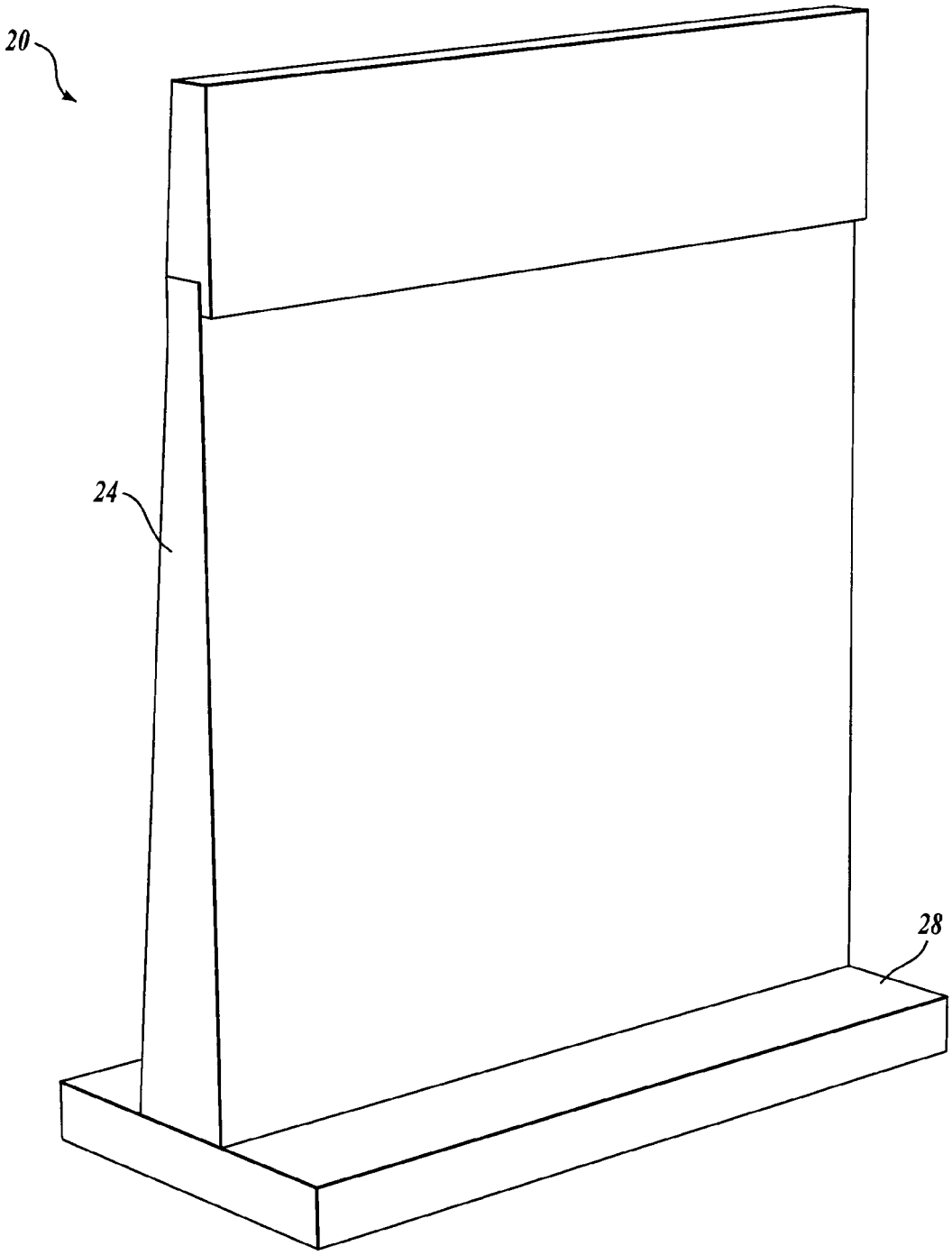
FIG. 1 is a perspective view of a retaining wall system formed in accordance with an embodiment of the present invention.
Figure 8:
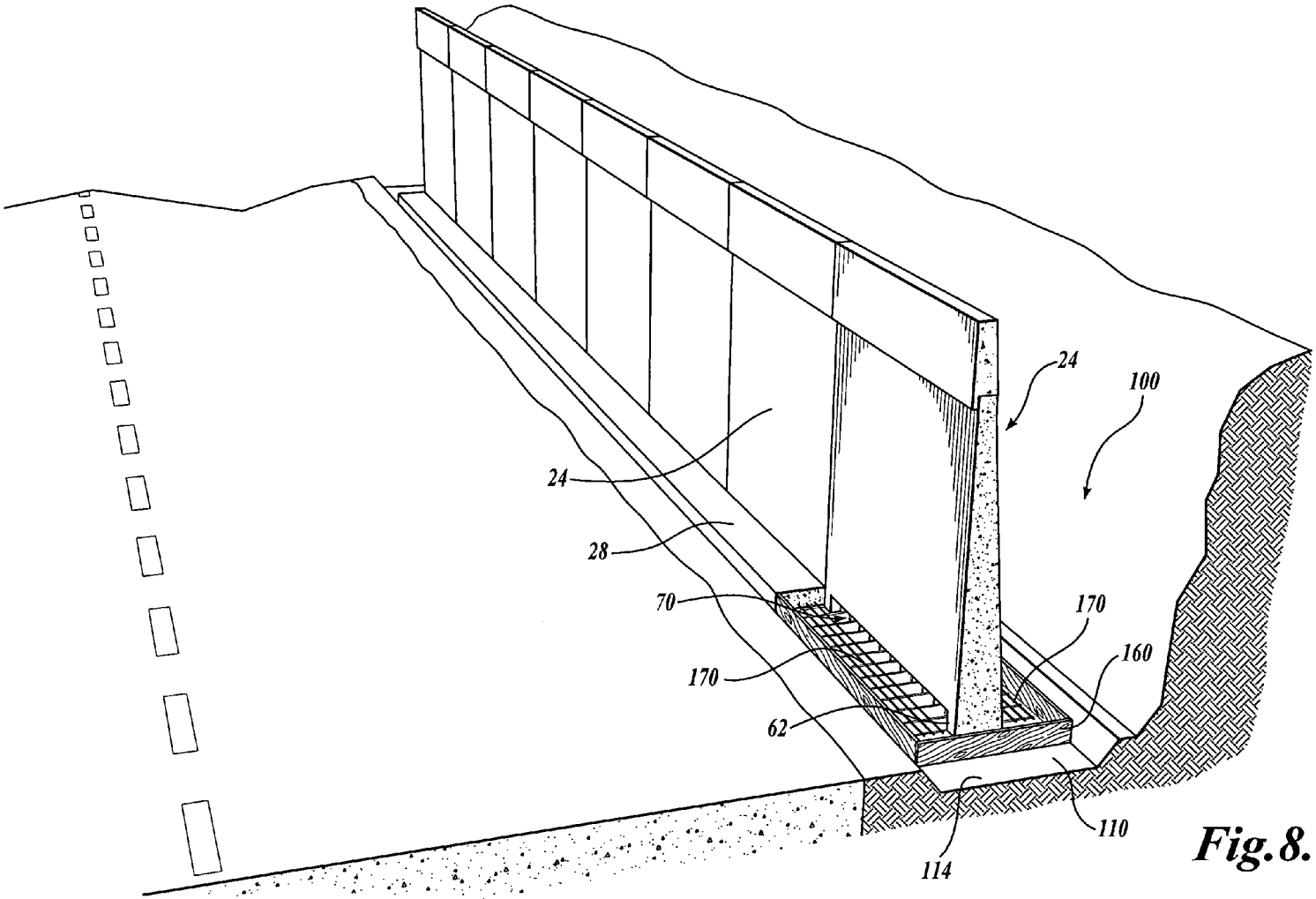
FIG. 8 is an environmental view of a continuous retaining wall being erected with the system of FIG. 1.

Embodiments of the present invention will now be described with reference to the accompanying drawings where like numerals correspond to like elements. The present invention is directed to pre-cast concrete wall systems for retaining earth and method of making the same. One illustrative embodiment of a retaining wall system, generally designated 20, suitable for use as a traffic barrier for roadways is shown in FIG. 1. As shown in FIG. 1, the retaining wall system 20 includes a prefabricated or pre-cast concrete retaining wall section 24 (hereinafter "the retaining wall section 24") and a pour-in-place footing 28. In use, a plurality of retaining wall sections 24 may be placed side-by-side in close proximity to one another to allow for a continuous retaining wall to be constructed, as shown in FIG. 8. A seal or other structure (not shown) for preventing fluid leakage can be compressed between the side edges of the wall sections to ensure a soil tight seal.

Referring now to FIGS. 2-7, the retaining wall section 24 will be described in detail. The retaining wall section 24 comprises a unitary wall body 30 having a base section 34 and an upper section 38. The wall body 30 defines a front surface 40, a back surface 42, a top surface 46, a bottom surface 50, a left side 54, and a right side 58. For description purposes, the front surface 40 of the retaining wall section 24 is generally the side that will be seen facing the roadway after the wall is complete. The front surface 40 may be finished in an architecturally pleasing manner, if desired.

The back surface 42 of the retaining wall section 24 typically faces the soil. The retaining wall section 24 may be constructed to be wider from front surface 40 to back surface 42 at the base section 34 as compared to the 16 upper section 38 proximate to the top surface 46. As such, the retaining wall section 24 tapers as it extends from the bottom surface 50 to the top surface 46. This may be done to maximize the strength of the retaining wall section 24, while minimizing the amount of material used to construct the retaining wall section 24.

At the bottom surface 50 of the retaining wall section 24 there are formed laterally spaced support members or legs 62. In the embodiment shown, the support members 62 are adjacent to the left and right sides 54 and 58 of the retaining wall section 24; however, the support members 62 may be spaced inward from the sides 54 and 58 of the retaining wall section 24, if desired. The support members 62 extend outward from the bottom surface 50 of the retaining wall section 24 a selected distance. The support members 62 may have any cross-section, although rectangular is shown. In use, support members 62 allow the retaining wall section 62 to stand perpendicular to the surface of the ground and may be as wide as the wall base section 34. The length of the support members 62 can vary with the size of the finishing retaining wall. In one embodiment, the support members 62 are not longer than 12", though this may vary as needed (i.e., greater or less than 12").

The retaining wall section 24 may further include at least one, and preferably, a plurality of steel reinforcement members 66, known in the industry as "rebar." The reinforcement members 66 may be laterally and/or longitudinally disposed or embedded throughout the retaining wall section 24, or may be disposed in any orientation, depending on the final shape of the retaining wall section 24 and the application of the retaining wall system 20. Alternatively, the reinforcement members 66 may be in the form of reinforcement wire mesh (shown in FIG. 9) embedded throughout the retaining wall section 24 to resist directly applied stresses to the pre-cast concrete wall section. In either case, a plurality of reinforcement members 66 extend out from the bottom surface 50 of the retaining wall section 24 and into the gap 70 formed between the support members 62. The reinforcement members may then be bent to form end sections 74. The end sections 74 may be somewhat laterally disposed toward the front surface 40 of the wall section 24.

Figure 2:
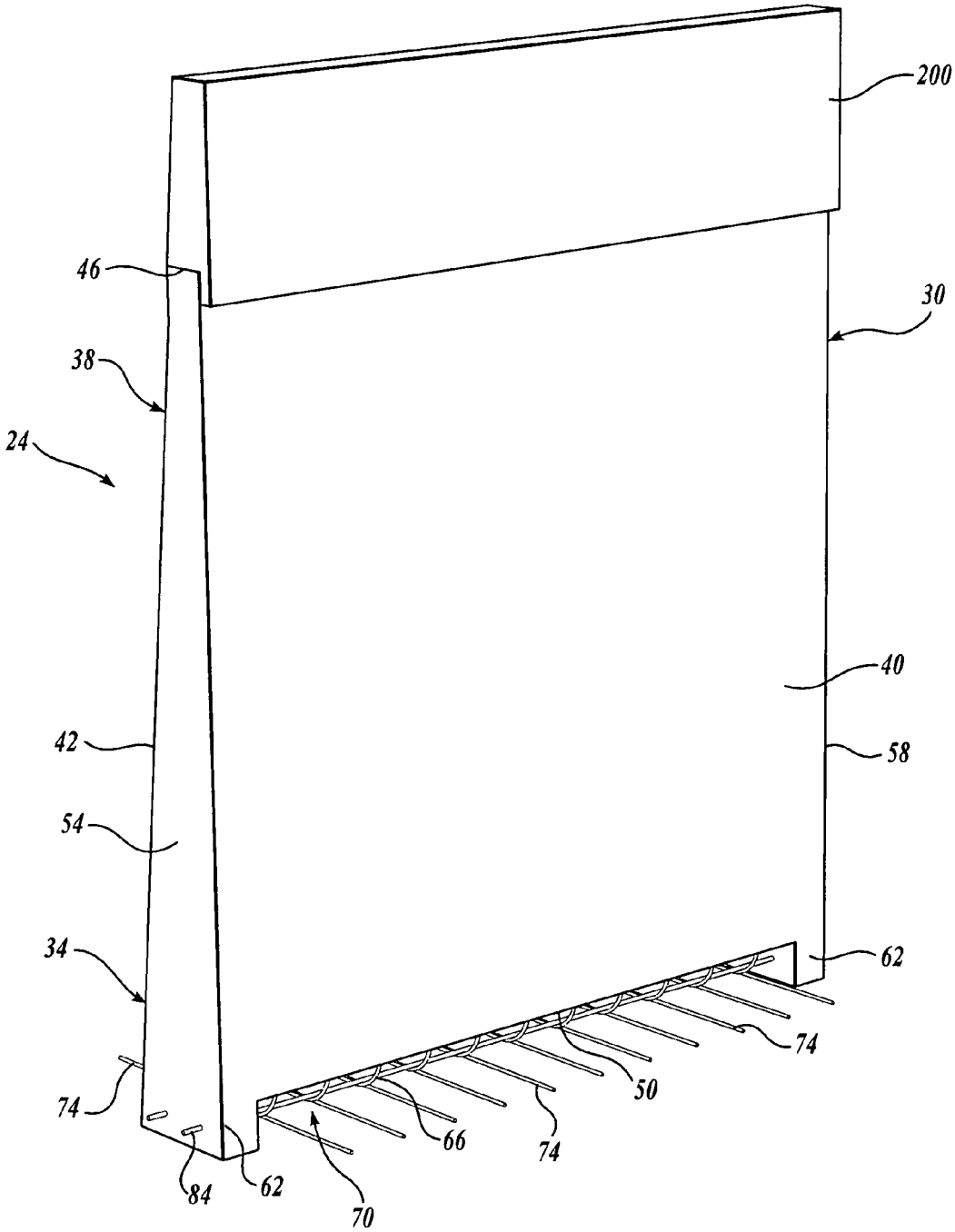
FIG. 2 is a perspective view of one embodiment of a retaining wall section suitable for use in the system of FIG. 1.
Figure 3:
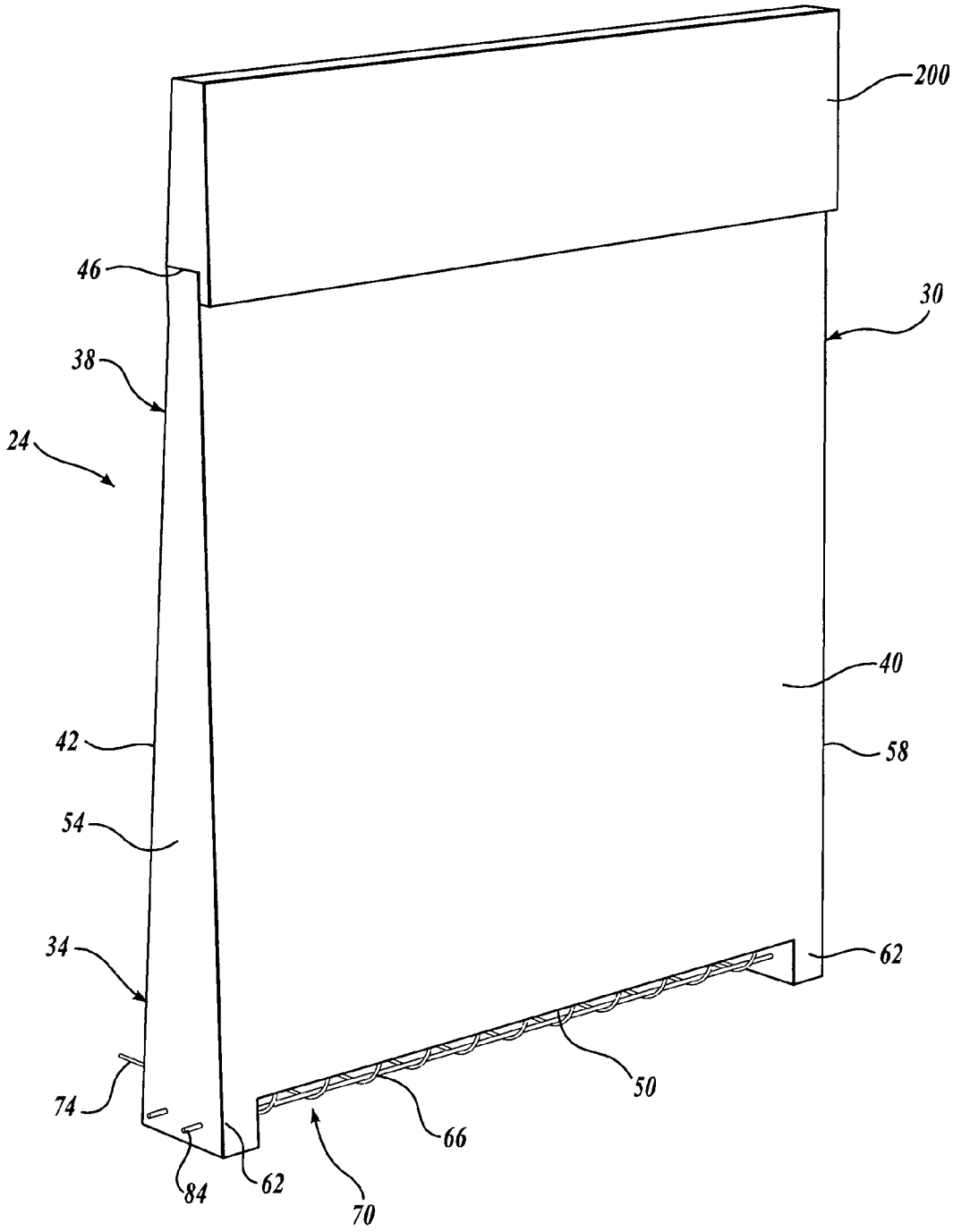
FIG. 3 is a perspective view of another embodiment of the retaining wall section suitable for use in the system of FIG. 1.
Figure 4:
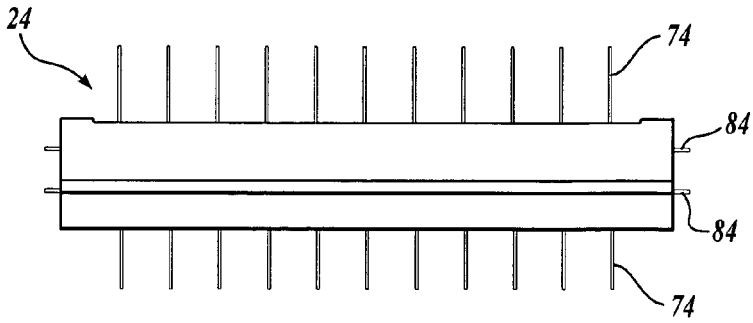
FIG. 4 is top view of the retaining wall section of FIG. 2.
Figure 5:
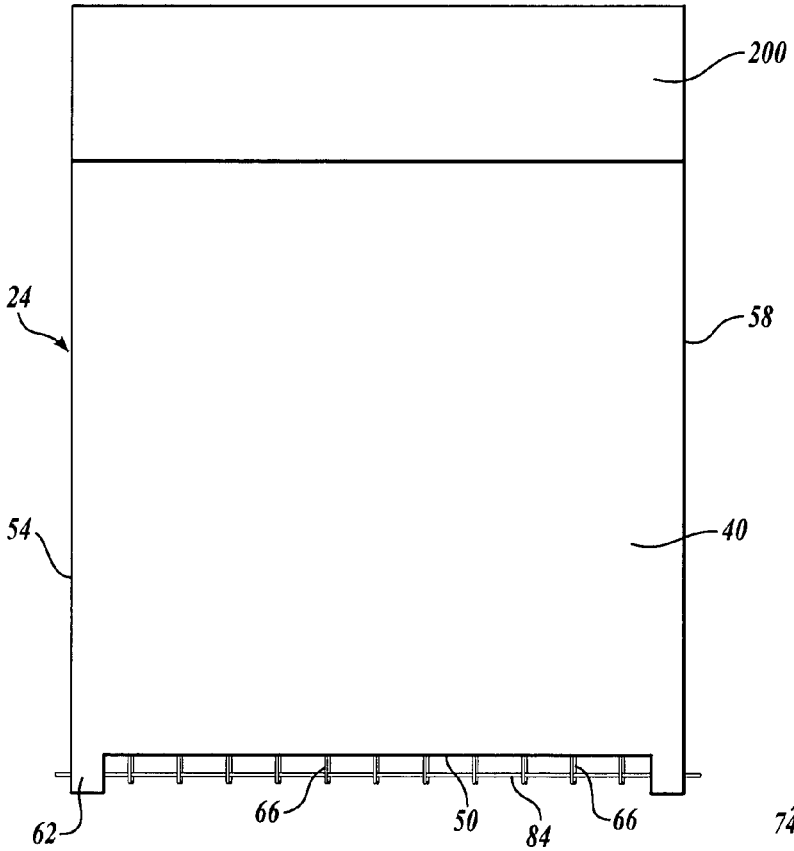
FIG. 5 is front view of the retaining wall section of FIG. 2.
Figure 6:
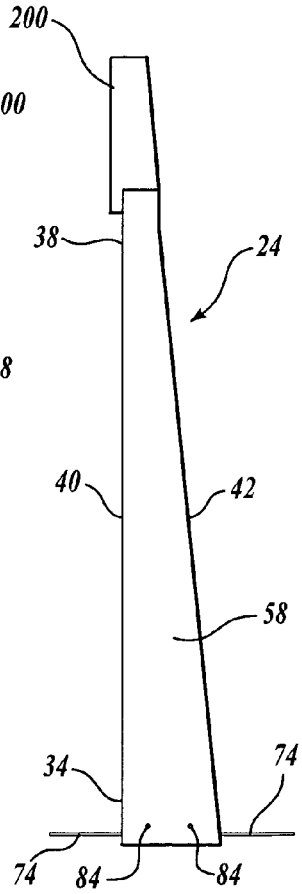
FIG. 6 is side view of the retaining wall section of FIG. 2.

It will be appreciated that the reinforcement members 66 may extend vertically downward when the retaining wall section 24 are cast, and then bent into the position shown in FIGS. 2 and 3 at the construction site. Alternatively, the reinforcement members 66 may be bent prior to pouring the concrete for the pre-cast retaining wall section 24. The reinforcement members 66 may be bent in either the forward (i.e., in the direction of the front surface 40) and/or rearward direction (i.e., in the direction of the back surface 42), as desired, to form the end sections 74 (FIG. 2 illustrates the reinforcement members being bent in both directions, while FIG. 3 illustrates the reinforcement members being bent in one direction). While the end sections 74 of the reinforcement members 66 appear to be disposed into a somewhat horizontal orientation, the end section 74 of the reinforcement members 66 may be disposed at any angle with respect to the front or back surfaces 40 and 42. However, it is preferable that the reinforcement members 66 are sufficiently bent so that the end section 74 of the reinforcement members 66 do not extend below the bottom edge of the support members 62 when installed.

Figure 7:
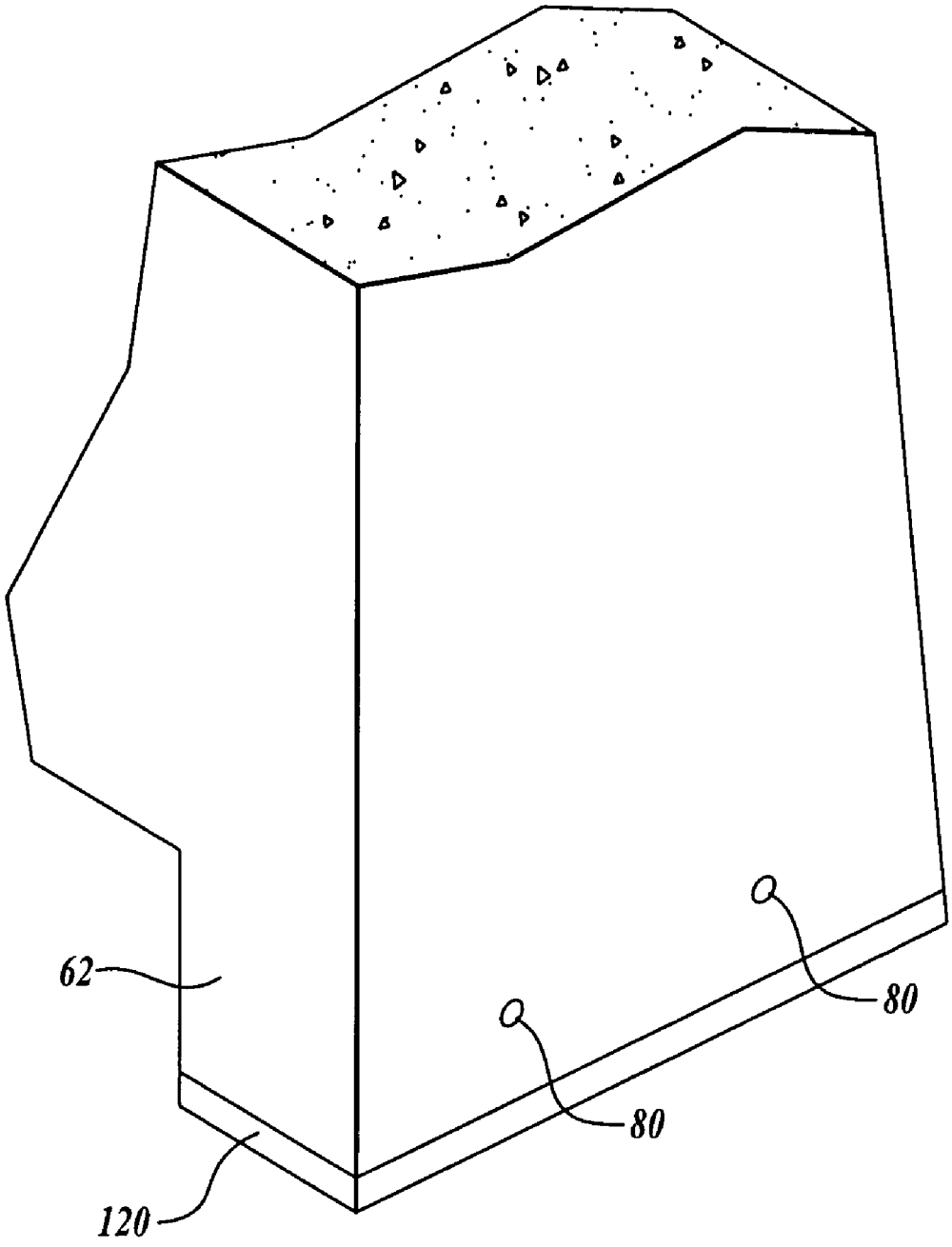
FIG. 7 is a magnified view showing a support member in detail.

The retaining wall section 24 may further include at least one and, preferably, a plurality of aligned, laterally spaced throughbores 80 disposed in each support member 62 along its width (see FIG. 7). The throughbores 80 are configured and dimensioned for receiving a reinforcement member 84 therethrough, as best shown in FIGS. 2-6. In use, a reinforcement member 84 may be inserted through one or both support members 62, and mechanically connected to the reinforcement members 66. In one embodiment, the throughbores 80 are arranged at a height related to the laterally disposed end sections 74 of the reinforcement members 66 such that the reinforcement members 84 rest on top of are disposed just below the end sections 74.

One method of installing the retaining wall system 20 in accordance with aspects of the present invention will now be described in detail with reference to FIGS. 1-11. In order to install the system 20 at a job site, the general area 100 (see FIG. 8) surrounding the resting position of the retaining wall section 24 is prepared. For example, the site may be excavated, thereby removing or relocating earth and soil. A footing hole or trench 110 (see FIG. 8) is then excavated. The trench 110 is suitably sized for the height of the retaining wall section 24 and the size of the footing 28 (see FIG. 1) to be poured. The bottom surface 114 of the trench 110 may be compacted in such a way that the weight of the retaining wall section 24 will not settle or sink over time. The trench 110 may include crushed aggregate or other subgrade preparation (not shown), if needed. The area of the bottom surface 114 of the trench 110 that will support the support members 62 of the wall section 24 may require additional preparation. These locations may need to be surveyed after compaction to ensure the retaining wall section 24 will be aligned properly upon completion.

The retaining wall section 24 is then picked up and placed into the trench 110 upon support members 62 with a crane or other lifting apparatus not shown. As such, the gap 70 is generated between the support members 62 and the bottom surface 114 of the trench 110, which will be used for a portion of the footing 28, as will be described in more detail below. Once the retaining wall section 24 has been placed in the trench 110, the alignment of the wall section 24 can be checked and adjusted, if desired. While not required, it is preferable that the wall sections 24 of the continuous retaining wall are accurately aligned both vertically and horizontally in order to maintain a high standard of architectural finish. Height adjustments can be made by placing shims 120 or other similar structures known in the art, under the support members as necessary to lift either the left side 54 or the right side 58 (shims are illustrated in FIG. 7). In order to place these shims 120 in place, a jack or other common lifting apparatus (not shown) can be placed under the bottom surface 50 of the retaining wall section 24. Alternatively, hooks (not shown) may be cast into the wall sections 24 or holes may be formed in the wall section 24 to receive a corresponding lifting device for adjusting the position of the wall section 24. The shims 120 could also be placed during the initial setting of the wall section 24. Once there is sufficient gap under the support members 62, shims 120 can be placed until the desired wall section position is achieved.

Figure 9:
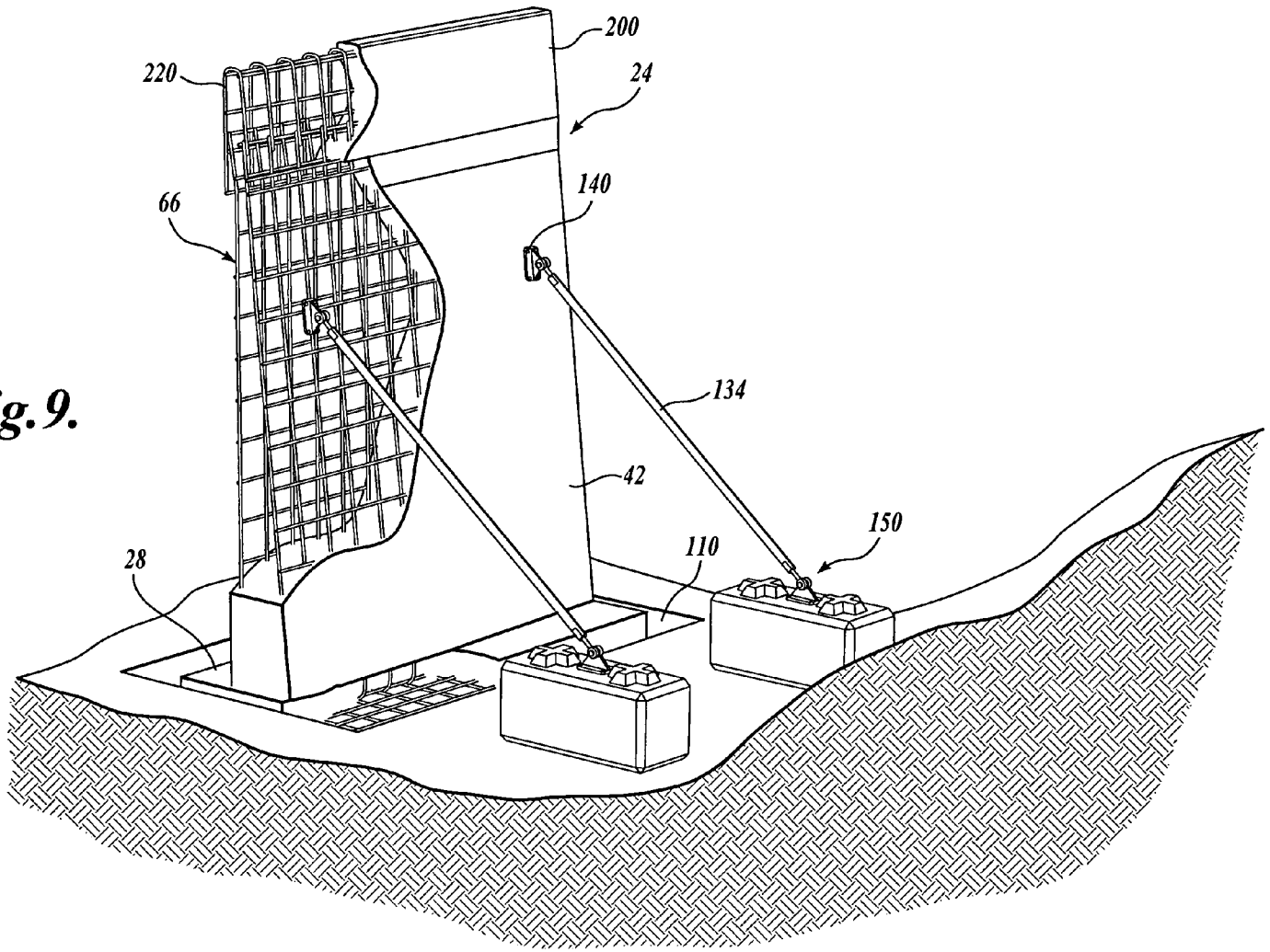
FIG. 9 is a perspective view of the retaining wall system placed in the trench, with the footing already constructed and the retaining wall section being temporarily supported by braces.
Figure 10:
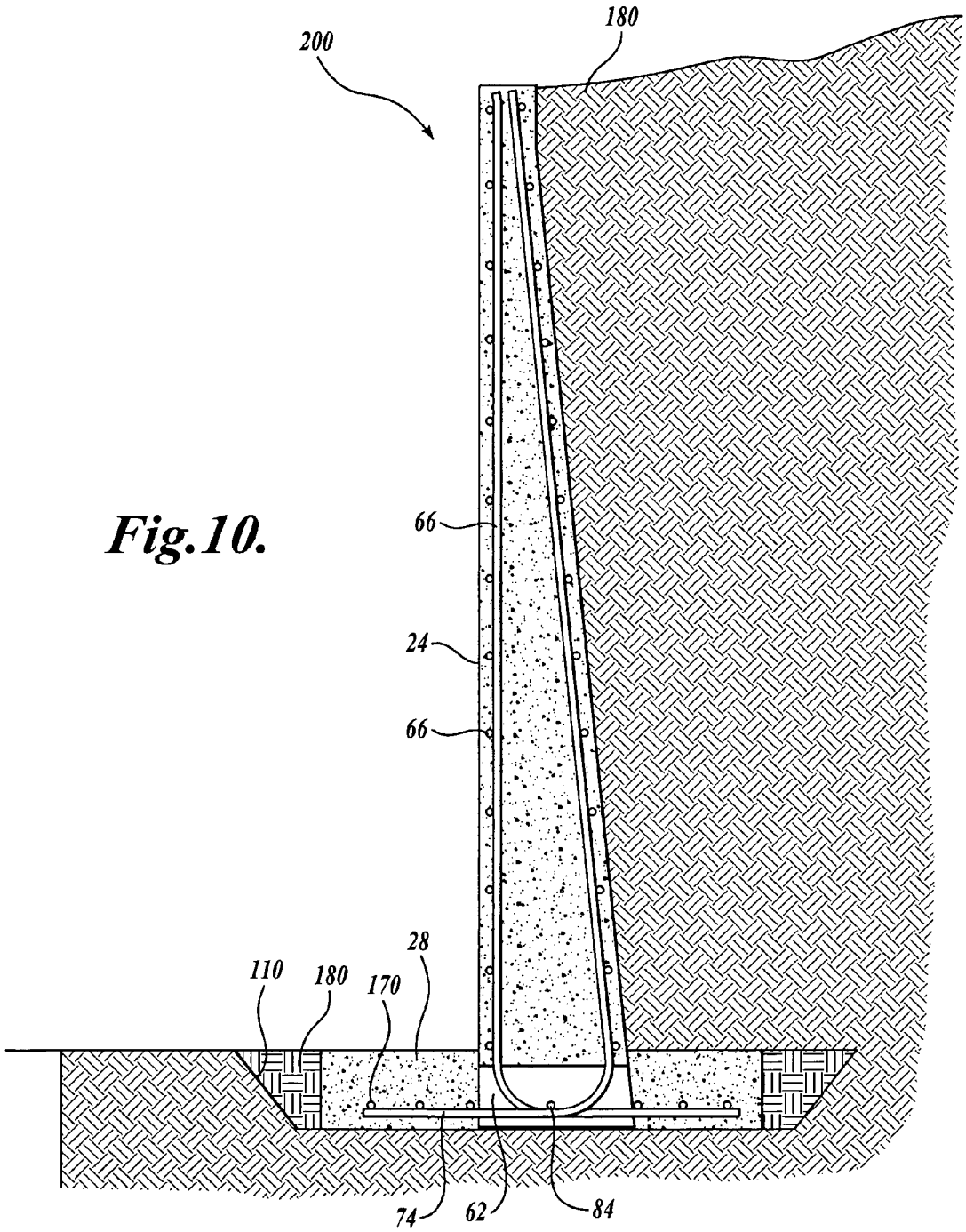
FIG. 10 is a side elevation view showing the completed retaining wall system in use without the optional traffic barrier.
Figure 11:
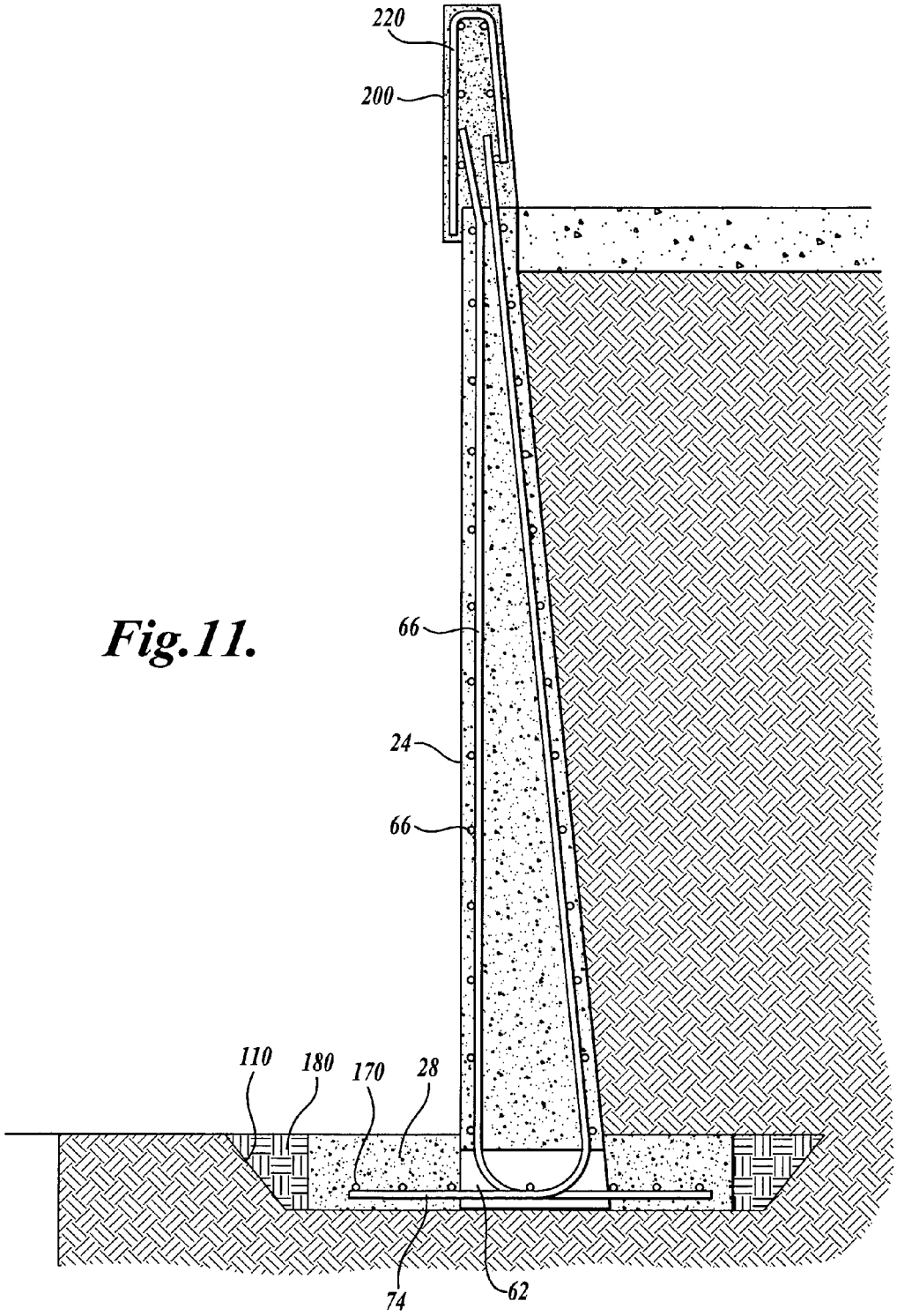
FIG. 11 is a side elevation view showing the completed retaining wall system in use with the optional traffic barrier.

The retaining wall section 24 may be optionally secured temporarily in its desired position prior to forming the footing 28. In order to temporarily secure the wall section 24 before the footing 28 is formed, temporary braces 134 or other support structure may be used. The number of braces 134 may depend on the size and shape of the wall, or the size, shape, and material of the braces. In one embodiment, the retaining wall section will use two such braces 134. As shown in FIG. 9, these braces 134 may be coupled to the retaining wall section 24 by a bracket 140 that is fastened to the retaining wall section 24, for example, by mechanical fastening devices. Alternatively, the brackets may have been cast in place. The braces 134 are connected to the bracket 140 by a pin or other securing device. As shown in FIG. 9, the side of the brace 134 opposite of the back surface 42 of the wall section 24 is connected to a structure 150, such as an ecology block, via any known mechanical arrangement.

Once the retaining wall section 24 is in place and properly secured with the temporary braces 134, the footing 28 can then be prepared. A footing 28 of ample size can be made at the base section 34 of the retaining wall section 24 using the gap 70 created between the support members 62, the size typically designed based on the size and shape of wall section 24. The footing 28 is prepared by first constructing a footing form 160 of a sufficient size around the base section of the retaining wall section 24. Typically, the top edge of the footing form is above the elevation of the bottom surface 50 of the wall section 24. Next, a plurality of reinforcement members 170 may be disposed laterally (i.e., along the length of the wall section) within the inner cavity created by the form 160. In one embodiment, the reinforcement members 170 are placed across the wall section reinforced members 66 that extend out from the wall section 24. The reinforcement members 170 of the footing 28 can be tied or mechanically connected to the reinforcement members 66 of the retaining wall section 24. Additional reinforcement members 84 (FIG. 4) can be inserted through throughbores 80 (FIGS. 4 and 5) in each support member 62. All of the reinforcement members 66, 84, and 170 may then be tied or mechanically connected together, if desired, so that the footing 28 becomes an integral part of the wall section 24 once the poured concrete has cured. Concrete is then poured into the form 160 and finished, as known in the art. After the concrete of footing 28 has cured, the temporary braces 134 (not shown in FIG. 8) and related components can be removed, if used. Once all of the temporary braces 134 have been removed, soil or earth 180 (FIG. 10) can then be "backfilled" or placed behind the wall section 24 and into the trench 110 to a suitable level.

As best shown in FIGS. 2-7, an optional barrier 200 can be added to the top surface of the wall section 24, if desired. This barrier 200 is often used to keep vehicular traffic from driving over the top of the wall sections 24. There are many different styles of this type of barrier 200. One embodiment of the present invention uses a barrier 200 and pre-casts the barrier onto the wall section 24. The barrier 200 may have reinforcement members 220 (FIG. 9) that can be integrated with the reinforcement members 66 of the retaining wall section 24 to make an integral wall section.

Figure 12:
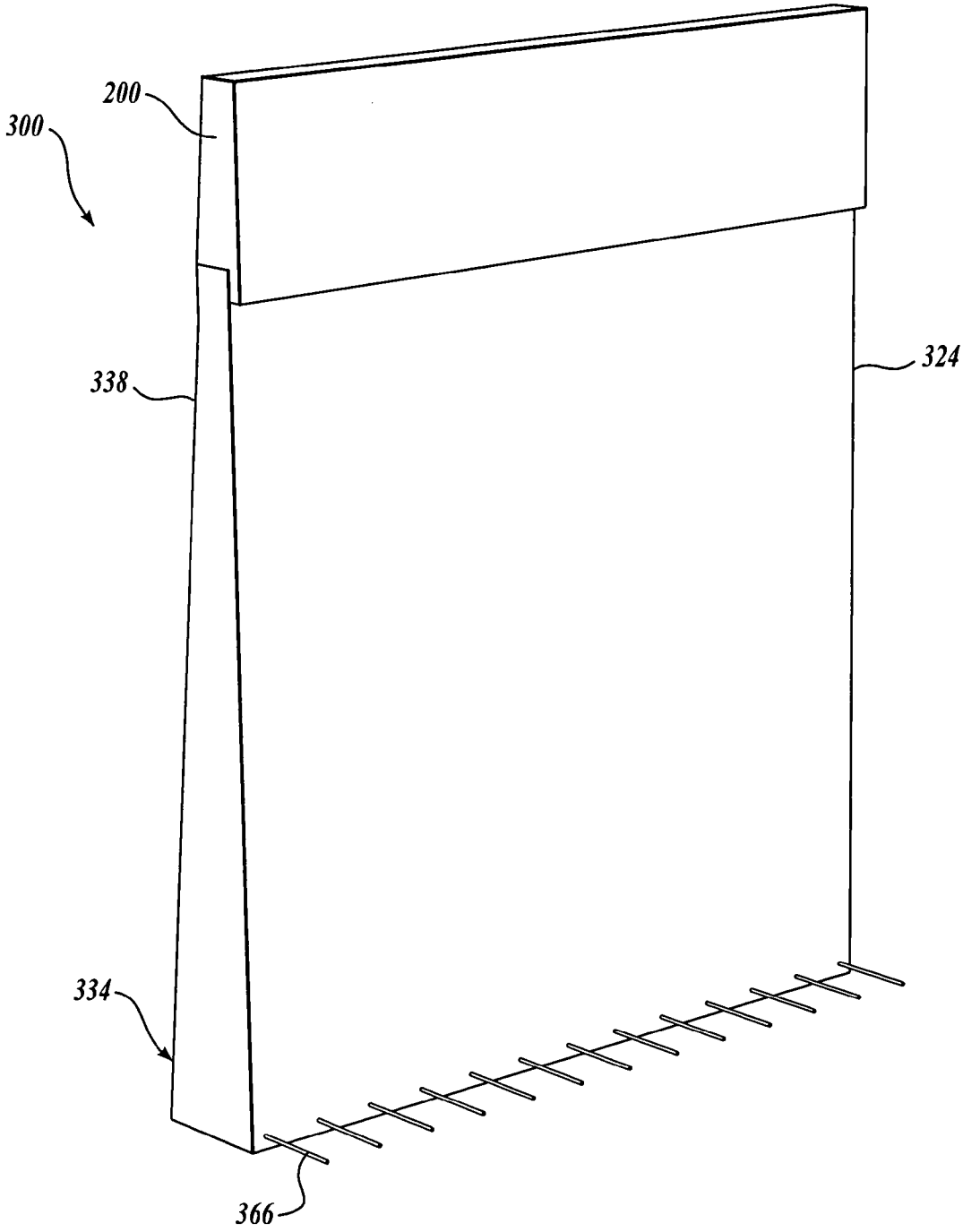
FIG. 12 is an alternative embodiment of a retaining wall section constructed in accordance with aspects of the present invention.

FIG. 12 is another embodiment of a retaining wall section 300 that is suitable for use in the retaining wall system 20 described above. The retaining wall section is substantially similar in materials, construction, and operation as the retaining wall section 24 described above, except for the differences that will now be described. The retaining wall section 324 has omitted the support members, and thus, has a somewhat rectangular shaped base section 334 that can be placed upon the bottom surface of the trench. The reinforcement members 366 of the retaining wall section 324 protrude outwardly from the base section 334, and may be mechanically connected to reinforcement members of the footing to be poured.

Figure 13:
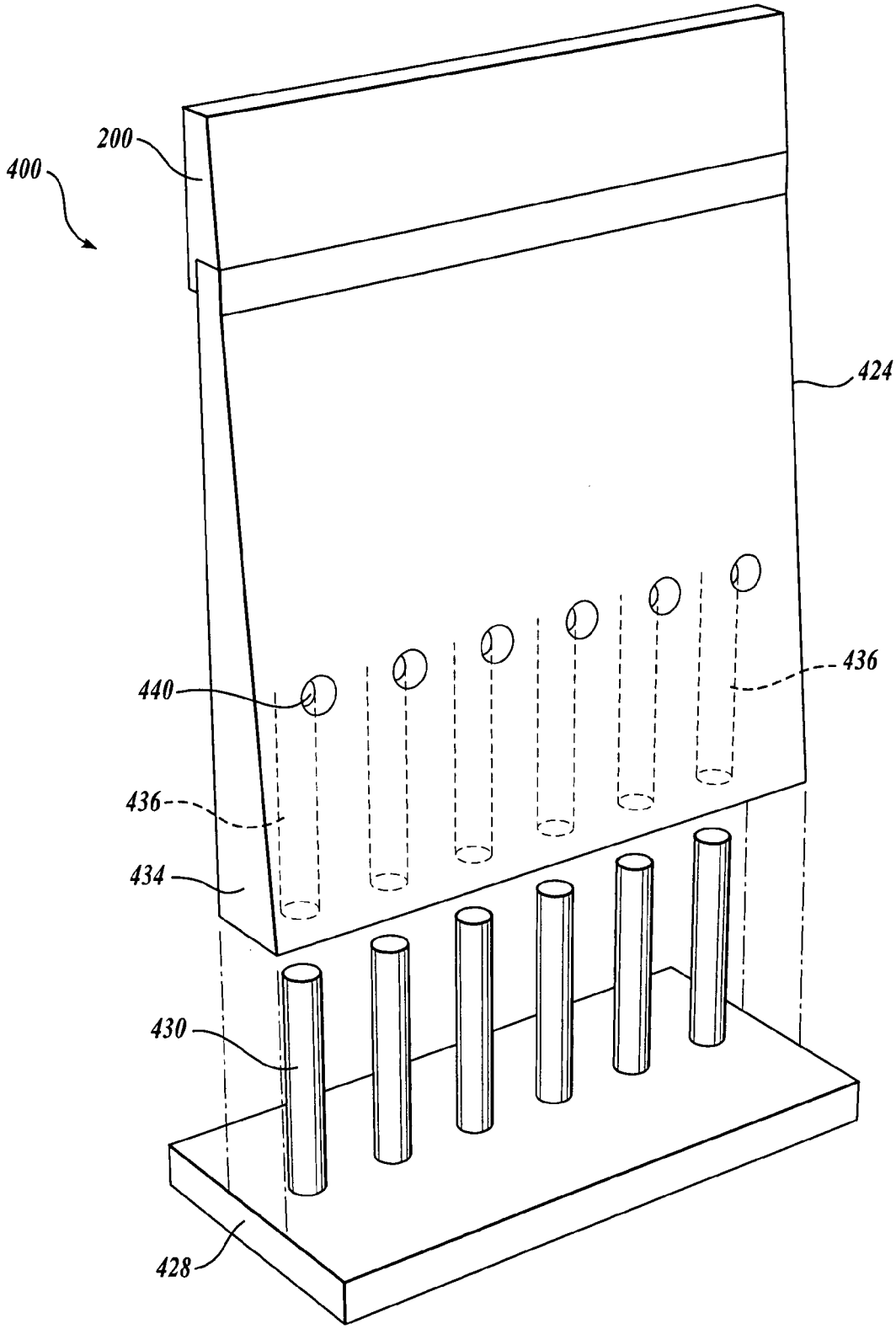
FIG. 13 is an exploded view of an alternative embodiment of a retaining wall system constructed in accordance with aspects of the present invention.

FIG. 13 illustrates another embodiment of a retaining wall system 400. The retaining wall system includes a footing 428 and a retaining wall section 428. The footing 428 may be pre-cast or may be poured on site. The footing 428 includes a plurality of reinforcement members 430 protruding upwardly therefrom. The retaining wall section 424 defines a base section 434. The retaining wall section 424 includes longitudinally extending bores 436 positioned in the base section 434 of the retaining wall section 424. The bores 436 are suitably configured and dimensioned to loosely receive the reinforcement members 430 therein when the retaining wall section 424 is lowered onto the footing 428. The retaining wall section 428 further includes bores 440 that extend from the back surface of the retaining wall section 424 and communicate with bores 436. Optionally, the retaining wall section 424 may include a traffic barrier 200 mounted on the top thereof.

To assemble the retaining wall system 400, a trench where the retaining wall system 400 is to be placed is excavated. Next, either a pre-cast footing 428 is placed in the trench, or the footing 428 is constructed by using forms, as known in the art. After the footing 428 is in place in the trench, the retaining wall section 424 is aligned with and then lowered onto the footing 428 in such a manner that the reinforcement members 430 are cooperatively received in the bores 436. Once the retaining wall section 424 is in place on the footing 428, the retaining wall section 424 is mechanically connected to the footing 428. In one embodiment, grout, concrete, epoxy etc. may be injected into the bores 440 to fill the bores 436 for coupling the reinforcement members 430 to the retaining wall section 424.

While the preferred embodiments of the invention have been illustrated and described, it will be appreciated that various changes can be made therein without departing from the spirit and scope of the invention.

The embodiments of the invention in which an exclusive property or privilege is claimed are defined as follows:

1. A pre-cast retaining wall, comprising:

a wall body having a front surface, a back retaining surface, a top surface, a bottom surface, and first and second side surfaces, wherein the wall body defines a minor axis extending between the front surface and the back retaining surface and a major axis extending between the side surfaces;

a channel formed in the wall body adjacent the bottom surface and between first and second legs, wherein the channel extends from the front surface of the wall body to the back retaining surface of the wall body; and at least one reinforcement member extending from the bottom surface of the wall body and into the channel.

2. The pre-cast retaining wall of claim 1, wherein the reinforcement member extends through a portion of the wall body.

3. The pre-cast retaining wall of claim 1, further including a plurality of reinforcement members extending from the bottom surface of the wall body.

4. The pre-cast retaining wall of claim 1, further including a plurality of reinforcement members extending through a portion of the wall body.

5. The pre-cast retaining wall of claim 1, wherein the wall body is reinforced with longitudinally and laterally extending members.

6. The pre-cast retaining wall of claim 1, wherein the channel forms first and second support legs, and wherein the first or second support leg includes a throughbore opening into the channel, the throughbore adapted to receive a reinforcement member therethrough.

7. The pre-cast retaining wall of claim 6, wherein the size of the first and second support legs are directly related to the height of the wall body.

8. The pre-cast retaining wall of claim 1, further comprising a barrier mounted to the top surface of the wall body.

9. The pre-cast retaining wall of claim 1, wherein the first and second side surfaces taper as the wall extends from the bottom surface to the top surface.

10. A pre-cast retaining wall, comprising:

a wall body having a front surface, a back surface, a top surface, a bottom surface, and first and second side surfaces, wherein the wall body defines a minor axis extending between the front surface and the back retaining surface and a major axis extending between the side surfaces; and a channel disposed in the wall body and forming first and a second support legs for supporting the wall body in-situ, wherein a portion of the channel is defined by the bottom surface of the wall body, wherein the channel is oriented so as to extend in the direction of the front or back surface through at least a portion of the wall body.

11. The pre-cast retaining wall of claim 10, wherein the channel extends between the front and back surfaces of the wall body.

12. The pre-cast retaining wall of claim 10, further comprising at least one reinforcement member extending outwardly from the bottom surface of the wall body and into the channel.

* * * * *